United States Patent [19]

Babendererde et al.

[11] 4,140,345

[45] Feb. 20, 1979

[54] TUNNEL-EXCAVATING MACHINE WITH SHIELD FORMED OF SEGMENTS

[76] Inventors: Siegmund H. F. L. M. Babendererde, Martin-Luther-Str. 10, 6868 Bad Vilbel, Fed. Rep. of Germany; Reinhard J. E. Bokemeyer, Gausstr. 36, 6050 Offenbach, Fed. Rep. of Germany

[21] Appl. No.: 838,941

[22] Filed: Oct. 3, 1977

[30] Foreign Application Priority Data

Oct. 5, 1976 [DE] Fed. Rep. of Germany ..... 2644899

[51] Int. Cl.[2] ..... E21D 9/08

[52] U.S. Cl. ..... 299/11; 299/31; 299/33; 405/142

[58] Field of Search ..... 299/11, 31, 32, 33; 61/85

[56] References Cited

U.S. PATENT DOCUMENTS 3,800,549 4/1974 Lobbe ..... 61/85

FOREIGN PATENT DOCUMENTS 597063 5/1934 Fed. Rep. of Germany ..... 61/85
617994 8/1935 Fed. Rep. of Germany ..... 61/85
2547021 4/1977 Fed. Rep. of Germany ..... 61/85

*Primary Examiner*—Ernest R. Purser
*Attorney, Agent, or Firm*—Karl F. Ross

[57] ABSTRACT

A tunnel-excavating machine comprises an excavating head, preferably a full-cut head, adapted to excavate the full-cross-section of the tunnel to be formed, which is slideably mounted for movement relative to a pair of support frames. Means is provided to relatively displace the support frames axially and the support frames are surrounded by a blade shield made up of a multiplicity of individual blade segments, each of which can be individually advanced by hydraulic means connected to the support frames. The individual blade members, which span both frames, can be urged against the wall of the tunnel by respective fluid pressure means in each of the frames.

5 Claims, 2 Drawing Figures

TUNNEL-EXCAVATING MACHINE WITH SHIELD FORMED OF SEGMENTS

FIELD OF THE INVENTION

The present invention relates to a tunnel-excavating machine and, more particularly, to a tunnel excavator of high versatility adapted to excavate a tunnel in subterranean strata without damage or destruction thereof.

BACKGROUND OF THE INVENTION

It has already been proposed to provide tunnel-excavating machines which are formed with cutting means adapted to be advanced relative to a pair of support frames which can be provided with means bearing against the tunnel wall.

A tunnel-excavating machine of this type generally comprises a pair of support members which are urged outwardly on the forward and rearward support frames independently to support the frames alternately against the wall.

The support means of one of the frames can thus be urged outwardly into engagement with the tunnel wall while the excavating head is forced forwardly, the other frame, whose support members are drawn inwardly, being simultaneously advanced. During the next stage of operation, the members of this latter support frame are urged outwardly to engage the tunnel wall while the support members of the first-mentioned frame are retracted and the latter support frame is then advanced. The process can then be repeated over the entire length of the stretch of tunnel to be excavated.

While such tunnel-excavating machines have a relatively large rate of advance through subterranean strata, the use thereof involves certain difficulties. In order to provide a fairly fixed support for the cutting head, the support members of the frame which is fixed during advance of the head, must be urged outwardly at extremely high pressure. When the strength of the strata through which the tunnel is to be excavated is limited, such high supporting pressures, applied over the limited axial length of the support frame and its members, have been found to disrupt the geological stratum through which the machine is advanced.

Damage to the subterranean formation reduces the speed with which the machine can excavate and, if insufficient support is provided, prevents the cutting head from advancing properly.

Furthermore, when the wall of the tunnel is damaged in this manner, there is a danger to operating personnel behind the machine and effective stabilization of the completed tunnel wall is difficult. In fact, the use of such machines in strata which have already been subjected to geological faults and the like, has been found to be impractical.

There have also been provided so-called cutter excavators in which an annular blade shield having a plurality of blade segments or members is advanced through a subterranean stratum. Such cutter blade machines, in which the leading edge of each of the shield segments forms a cutter which actually cores the tunnel from the stratum, have been found to be effective only for relatively soft and yieldable subterranean structures. The machines are not usable where varying geological conditions obtain or for harder subterranean formations.

OBJECTS OF THE INVENTION

It is the principal object of the present invention to provide a tunnel-excavating machine which avoids the disadvantages of the earlier systems.

Another object of this invention is to provide an improved tunnel excavator which can be used in subterranean formations and structures of various types and structures which have previously been subjected to faulting or other dislocation.

Yet another object of this invention is to provide an improved tunnel excavator which permits a high rate of excavation to be obtained even in geological strata which have hitherto been considered as problematical for machine excavation.

SUMMARY OF THE INVENTION

These objects and others which will become apparent hereinafter are attained, in accordance with the present invention, in a tunnel-excavating machine which comprises an excavating head, preferably a full-cut head, which can be axially (longitudinally) advanced relative to a pair of support frames. The support frames can be provided with means for relatively displacing them longitudinally, i.e., axially, and for enabling the displacement of the full-cutting head relative to these frames.

According to the principles of the present invention, the two frames are surrounded by a blade shield constituted by a circumferential array of angularly equispaced and individual shield blades, each of which constitutes a cylinder segment and is provided with a cutting edge at its leading end.

It is essential, for the purposes of the present invention, that these blades have a length which is at least equal to the axial dimensions of the two support frames. Each of the shield blades, therefore, extends over (i.e., spans) both support frames and, according to a feature of the invention, is provided with a pair of hydraulic cylinders (press cylinders), one of which is disposed at a relatively forward location along the blade on a forward one of said frames, while the other is disposed at a relatively rearward location on the blade and is carried by the rear support frame. One of the support frames and each blade can be connected with a further hydraulic cylinder arrangement (feed cylinder) for advancing the blade relative to the support frames.

According to the invention, each of the blade segments is advanced individually and hence the two press cylinders operating thereon can be relieved while the feed cylinder can be operated to move the blade as the remaining blade segments remain pressed against the wall of the tunnel. Under these circumstances, the pressure against the tunnel wall can be distributed over all of the length of the shield and hence at least over the axial dimensions of both support frames.

According to the invention, the individual shield blades are relieved and can be moved, i.e., advanced, without contact with the tunnel wall so that the shear resistance to advance of the segments is negligible.

Since the inward pressure upon the tunnel by the subterranean structure is taken up by the entire blade shield and, conversely, the outward pressure securing the "fixed" frame temporarily against movement during advance of the other frame is applied over the full periphery and length of the blade shield, damage to the structure is minimized. During advance of the two frames, the blade shield remains in contact with the tunnel wall so that there is little tendency to loosen the surrounding subterranean structure.

As a consequence, in spite of the fact that a machine is used which applies outward pressure to the tunnel structure, there is no significant pressure relieving of the walls which retain their supporting characteristics. This has been found to be especially important in the construction of vehicular tunnels in municipalities and the like where settling of the surface is a danger which is frequently involved in tunnel construction. With tunneling using the machine of the present invention, such phenomena are completely avoided. In other words, the wall of the tunnel is fully supported at all times during the operation of the machine of the present invention.

It has been found to be advantageous to provide the forward support frame with a horizontal central platform in which the cutting head is guided and which is received in the rear support frame in a pair of grooves or channels therein to enable relative displacement of the two support frames.

The hydraulic cylinder and piston arrangement for the advance of each of the shield blades is preferably mounted in the forward support frame as well.

It has been found to the advantageous, moreover, to form the outer peripheries of the support frames as cylindrical surfaces in which the pressing cylinders are disposed radially. The latter cylinder arrangements can also be received in respective longitudinal grooves formed along inwardly turned surfaces of the blade segments to enable the relative longitudinal displacement of the support frames and these segments.

This construction has been found to provide a convenient way of supplying the cylinders with hydraulic fluid, and in general to control the various operations of the machine.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
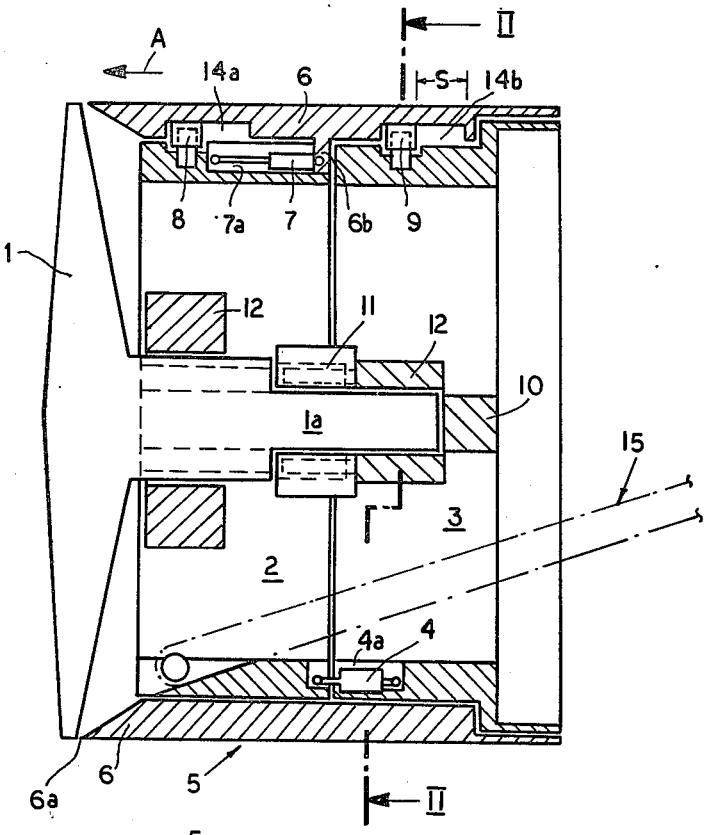
FIG. 1 is a somewhat diagrammatic axial cross-sectional view through a tunnel-excavating machine according to the invention.

The tunnel excavating machine shown in the drawing comprises a full-cut head 1 which can be of any conventional construction and can be provided with driven excavating blades (not shown). These blades can be carried on five angularly equispaced arms (FIG. 2) mounted upon a common support 1*a* (FIG. 1).

The head 1 is longitudinally displaceable relative to a wall-supporting structure which comprises a pair of support frames 2 and 3 which are disposed one behind the other in the longitudinal direction of advance of the tunnel.

These support frames can be relatively displaced in the longitudinal direction by angularly equispaced hydraulic cylinder arrangements 4 and carry a support means in the form of a blade shield 5 which can be pressed radially against the tunnel wall, i.e. the subterranean structure. The hydraulic cylinder arrangements 4, shown only diagrammatically, are received in recesses 4*a* in the shields.

The blade shield 5 extends in length over both of the support frames 2 and 3 and constitutes a plurality of peripherally spaced cylinder-segmental shield blades 6 each of which has a sharpened or inwardly bevelled leading edge 6*a*. Each of the blade segments 6 can be advanced on the direction of the arrow A by a hydraulic feed cylinder arrangement 7 which is received in a further recess 7*a* of the forward frame 2. Each of the segments 6 has an inwardly extending lug 6*b* to which the cylinder 7 is hinged for this purpose.

Each of the segments 6 is, moreover, provided with a longitudinally extending inwardly open front recess (groove) 14*a* and a rear recess 14*b* in each of which the cylinder of a respective hydraulic cylinder arrangement 8, 9 is provided. The hydraulic cylinders 8 are carried by the front frame 2 while the hydraulic cylinders 9 are carried on the rear frame. The hydraulic cylinders are fed with hydraulic fluid by ducts, not shown, in or on the respective frame.

The front frame 2 also carries a horizontally extending central platform 10 which, together with a pair of guides 12, is rigid with the front frame 2 and slideably carries the cutting head 1. The latter is longitudinally displaceable with respect to the guides 12 by a hydraulic feed mechanism represented at 11 and constituted by a plurality of angularly equispaced hydraulic cylinders shown only in broken lines in FIG. 1.

The platform 10 is, in turn, guided in a pair of diametrically opposite longitudinal grooves 13 formed in the rear frame 3.

The hydraulic presses or cylinder assemblies 8 and 9 are disposed radially about the periphery of the generally cylindrical support frames 2 and 3 and can slide in the inwardly open guide channels formed by the recesses 14*a* and 14*b*.

Figure 2:
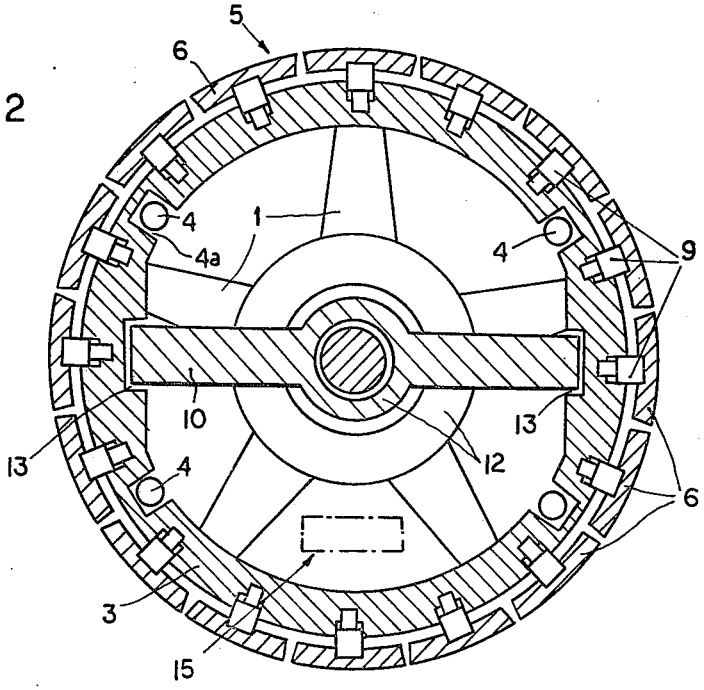
FIG. 2 is a cross-sectional view taken along the line II—II of FIG. 1.

The shield blades 6 are disposed with radial spacing from the support frames 2 and 3 as can be seen from FIGS. 1 and 2, while the hydraulic presses 8 and 9 can be individually actuated by respective control valves, not shown.

The machine illustrated in FIGS. 1 and 2 operates as follows:

With the machine in the position shown in FIG. 1, both hydraulic cylinder arrangements 8 and 9 of all of the blade segments 6 are energized with controllable and variable pressing pressures to press the blade segments outwardly uniformly against the previously formed wall of the tunnel.

The hydraulic cylinder arrangement 11 is then energized to advance the full-cut head 1 in the direction of arrow A over the length of a predetermined stroke which can correspond to the potential excursion of each of the shield blades 6 with respect to the frames 2 and 3.

The detritus removed by the cutting head 1 can be carried off by the conveyor 15. A "full-cut head," as this term is used in the present description, means a head which is intended to cut the full cross-section of the tunnel to be bored in the subterranean structure.

Thereafter, each of the blade segments 6 is advanced in the direction of arrow A individually.

To this end, both of the hydraulic presses 8 and 9 of each segment are relieved and the segment is thereby withdrawn fron contact with the tunnel wall and displaced by the respective feed cylinder 7 in the direction of arrow A. At the conclusion of this advance by the distance s, the hydraulic cylinders 8 and 9 are re-energized and pressure is again applied to the tunnel wall. The process is repeated for each of the blade segments in turn and, when all of the blade segments have been advanced, all of the hydraulic cylinders 8 of the shield 5 are relieved simultaneously and the cylinders 4 are energized to advance the support frame 2 by the distance s.

The hydraulic cylinders 8 are all then repressurized and the hydraulic cylinders 9 are relieved. The double acting cylinders 4 are then energized to draw the rear frame 3 forwardly by the distance s. The hydraulic cylinders 9 are repressurized and the machine is ready for the next operating cycle.

We claim:

1. A tunnel-excavating machine which comprises:

a first support frame and a second support frame disposed in a subterranean structure;

said first support frame disposed forwardly in the direction of advance of the machine through said subterranean structure in the formation of a tunnel and said second support frame being a rear support frame;

a cutting head mounted on and longitudinally shiftable relative to said support frames for cutting a tunnel in said structure, said first support frame being provided with a central platform guided in said second support frame and forming, in turn, a guide for said head;

a shield surrounding said support frames and comprising a plurality of angularly equispaced blade segments each extending longitudinally over both of said support frames;

means on one of said support frames for advancing said head relative to said support frames;

means on said support frames for relatively displacing said support frames in a longitudinal direction to follow said head;

a respective pressing hydraulic cylinder arrangement on each of said support frames engageable with each of said blade segments for urging said blade segments outwardly against a tunnel wall; and an advancing hydraulic cylinder arrangement connecting each of said blade segments with a respective one of said support frames for displacing said support frames and said blade segments individually longitudinally to follow said head, said advancing hydraulic cylinder arrangements being connected to said first support frame, each of said support frames having a generally cylindrical outer periphery and said pressing hydraulic cylinder arrangements are disposed radially on said peripheries and bear upon the respective blade segments in longitudinally extending, inwardly open grooves formed therein.

2. The machine defined in claim 1, wherein said segments are radially spaced from said frames and said pressing hydraulic cylinder arrangements are energizable with controllable and variable pressing pressures.

3. A method of forming a tunnel in a subterranean structure which comprises:

disposing within an initial stretch of tunnel a front support frame, a rear support frame, a full-cut head longitudinally shiftable on said support frames, and a blade shield surrounding said support frames and formed from a multiplicity of angularly equispaced blade segments;

pressing said segments radially against the wall of said initial stretch of tunnel to anchor said support frames thereon;

advancing said head to cut a further stretch of tunnel in said structure;

relieving the radial pressing force on each of said segments in turn and successively advancing said segments to follow said head;

subsequently pressing all of said segments against the wall of the further stetching of tunnel at one of said support frames;

thereafter relieving the pressing force at the other of said support frames and advancing same to follow said head;

applying radial pressing force to said segments at said other support frames;

thereupon relieving the radial pressing force at said one of said support frames and advancing same to follow said other of said support frames; and reapplying radial pressing force at said one of said support frames to said segments to enable further advance of said head.

4. A tunnel-excavating machine which comprises:

a first support frame and a second support frame disposed in a subterranean structure, said first support frame being disposed forwardly in the direction of advance of the machine through said subterranean structure in the formation of a tunnel and said second support frame being a rear support frame;

a cutting head mounted on and longitudinally shiftable relative to said support for cutting a tunnel in said structure, said first support frame being provided with a central platform guided in said support frame and forming, in turn, a guide for said head;

a shield surrounding said support frames and comprising a plurality of angularly equispaced blade segments each extending longitudinally over both of said support frames;

means on one of said support frames for advancing said head relative to said support frames;

means on said support frames for relatively displacing said support frames in a longitudinal direction to follow said head;

a respective pressing hydraulic cylinder arrangement on each of said support frames engageable with each of said blade segments for urging said blade segments outwardly against a tunnel wall; and an advancing hydraulic cylinder arrangement connecting each of said blade segments with a respective one of said support frames for displacing said support frames and said blade segments individually longitudinally to follow said head, said advancing hydraulic cylinder arrangements being connected to said first support frame, said segments being radially spaced from said frames and said pressing hydraulic cylinder arrangements are energizable with controllable and variable pressing pressures.

5. A tunnel-excavating machine which comprises:

a first support frame and a second support frame disposed in a subterranean structure, said first support being disposed forwardly in the direction of advance of the machine through said subterranean structure in the formation of a tunnel and said second support frame being a rear support frame;

a cutting head mounted on and longitudinally shiftable relative to said support frames for cutting a tunnel in said structure, said first support frame being provided with a central platform guided in said second support frame and forming, in turn, a guide for said head;

a shield surrounding said support frames and comprising a plurality of angularly equispaced blade segments each extending longitudinally over both of said support frames;

means on one of said support frames for advancing said head relative to said support frames;

means on said support frames for relatively displacing said support frames in a longitudinal direction to follow said head;

a respective pressing hydraulic cylinder arrangement on each of said support frames engageable with each of said blade segments for urging said blade segments outwardly against a tunnel wall; and an advancing hydraulic cylinder arrangement connecting each of said blade segments with a respective one of said support frames for displacing said support frames and said blade segments individually longitudinally to follow said head, said advancing hydraulic cylinder arrangements being connected to said first support frame, each of said support frames having a generally cylindrical outer periphery and said pressing hydraulic cylinder arrangements are disposed radially on said peripheries and bear upon the respective blade segments in longitudinally extending, inwardly open grooves formed therein, said segments being radially spaced from said frames and said pressing hydraulic cylinder arrangements are energizable with controllable and variable pressing pressures.

* * * * *